US005566830A

United States Patent [19]

Margolin

[11] Patent Number: 5,566,830

[45] Date of Patent: Oct. 22, 1996

[54] SAMPLE DISPLAY AND DISTRIBUTION DEVICE

[76] Inventor: Herbert E. Margolin, 11 Beacon La., East Northport, N.Y. 11731

[21] Appl. No.: 328,203

[22] Filed: Oct. 25, 1994

[51] Int. Cl.[6] ..... B65D 5/52

[52] U.S. Cl. ..... 206/730; 206/735; 229/104; 229/120.21; 53/474

[58] Field of Search ..... 206/44 B, 44.11, 206/45.19, 45.31, 45.34, 497, 459.5, 730, 735; 229/120.21, 104, 120.38; 53/154, 157, 474

[56] References Cited

U.S. PATENT DOCUMENTS

| | | | |
|---|---|---|---|
| 1,401,549 | 12/1921 | Nordstrom | 229/104 |
| 1,923,928 | 8/1933 | Jacobs | 229/104 |
| 2,031,381 | 2/1936 | McCallum | 206/44.11 |
| 2,126,461 | 8/1938 | Graham | 206/44.11 |
| 2,943,780 | 7/1960 | Bolding | 229/104 |
| 3,295,690 | 1/1967 | Ottman | 206/44.11 |
| 4,739,922 | 4/1988 | Zimmermann | 229/104 |
| 4,998,615 | 3/1991 | Bryan | 206/497 |
| 5,209,391 | 5/1993 | Krautsack | 229/104 |

FOREIGN PATENT DOCUMENTS

| | | | |
|---|---|---|---|
| 569089 | 11/1993 | European Pat. Off. | 229/120.21 |

*Primary Examiner*—David T. Fidei
*Attorney, Agent, or Firm*—Kenyon & Kenyon

[57] ABSTRACT

A collapsible sleeve having an inner wall and outer wall defining a longitudinal bore for displaying and distributing a product sample. A support wall is disposed within the bore. The support wall may be comprised of a plurality of inner panels projecting from the inner wall of the sleeve. The inner panels are adapted to selectively engage and disengage each other so as to form an interior support wall which imparts both shape and rigidity to the sleeve when it is in the erected position. The walls of the sleeve and the support wall define first and second longitudinal apertures. The first aperture is sized and adapted to receive and engage a container housing a retail consumer product. The second aperture is sized and adapted to receive, retain, protect and display a consumer product sample.

13 Claims, 10 Drawing Sheets

SAMPLE DISPLAY AND DISTRIBUTION DEVICE

FIELD OF THE INVENTION

This invention relates generally to merchandising packages for the marketing of consumer products and more particularly to a device for displaying and distributing a discrete consumer product sample at the point of purchase of another consumer product.

BACKGROUND OF THE INVENTION

In merchandising certain products, it is frequently desirable to include with the package being sold a sample of the same or another product. The sample may be used independently of or in conjunction with the product being sold and may be a variation of the product being sold. For example, if the product being sold contains a food product having a specific flavor, e.g., chocolate, the sample could be a vanilla flavored sample of the same product. This allows the merchandiser to target and distribute a sample to a purchaser who has already shown a high interest in that type of product and increases the chances that the sample will be distributed to a future purchaser of the sample. It is well known that under modern merchandising conditions the ability of a package to thus attract attention is frequently an important factor in determining whether or not a sale is made.

To be successful, the merchandising package, the product being sold, and the sample being distributed must be visible to the purchaser and attractively displayed so that the purchaser's attention is attracted and held. It is also desirable that the merchandising package be inexpensive and easily manufactured and compact and light so that it is easily and inexpensively stored and transported. It is also desirable that the merchandising package be quickly, easily, and inexpensively attached to both the product to be sold and the sample to be distributed either at the point of manufacture or at the retail point of sale. In addition, the sample should be securely retained within the merchandising package until the consumer removes it so that the sample is not easily lost or damaged.

Conventional methods of distributing samples with a product to be sold often involve attaching a sample to a product by taping, gluing or stapling the sample (or a bag containing the sample) to the product either at the point of shipment or at the retail store where the product will be sold. Another conventional method is to simply place the sample in proximity to the product, e.g., by placing it on the shelf next to the product or in a bin near the product. Some of the many shortcomings of these conventional methods are that they often are expensive, labor intensive, create a non-uniform shape making it difficult to box and ship the product once the sample has been attached, expose the sample to damage or loss, and result in a sloppy and unattractive display.

OBJECTS AND SUMMARY OF THE INVENTION

The present invention provides a sample merchandise display and distribution device which meets all of these requirements by providing a collapsible sleeve having an outer wall and an inner wall defining a longitudinal bore and a support wall disposed within the bore. The collapsible sleeve may be comprised of a plurality of side walls provided with a plurality of inner support panels projecting from the inner wall of the sleeve. The plurality of inner panels are adapted to selectively engage and disengage each other so as to form the interior support wall which imparts both shape and rigidity to the sleeve when it is in the set up or erected condition. The side walls and the interior support wall define first and second longitudinal apertures. The first aperture is sized and adapted to receive and retain a container housing a retail consumer product. The second aperture is sized and adapted to receive, retain, and display a product sample until the sample is removed by the consumer.

It is an object of this invention to provide a sample merchandise display and distribution device which is light, compact, easily stored, easily and inexpensively manufactured, and easily utilized.

It is another object of this invention to provide a sample merchandise display distribution device which is selectively collapsible and erectable.

It is another object of this invention to provide a sample merchandise display and distribution device which is fabricated from a single blank and which is quickly and easily erected by expanding the blank and which may be stored by collapsing the device into a substantially flat configuration.

It is yet another object of this invention to provide a merchandise display and distribution apparatus comprising a sleeve having a first end and a second end and an outer wall and an inner wall defining a longitudinal bore therethrough; a support wall having a first major surface and a second major surface positioned within the longitudinal bore between the first end and the second end, the first major surface of the support wall facing the first end of the sleeve, the first major surface of the support wall and the portion of the interior wall between the first major surface and the first end of the sleeve defining a first longitudinal aperture, the second major surface of the support wall and the portion of the interior wall between the second major surface and the second end of the sleeve defining a second longitudinal aperture, the first longitudinal aperture adapted to receive and retain a container housing a consumer product, and the second longitudinal aperture adapted to receive, retain, protect, and display a product sample.

DETAILED DESCRIPTION OF THE INVENTION

Figure 1:
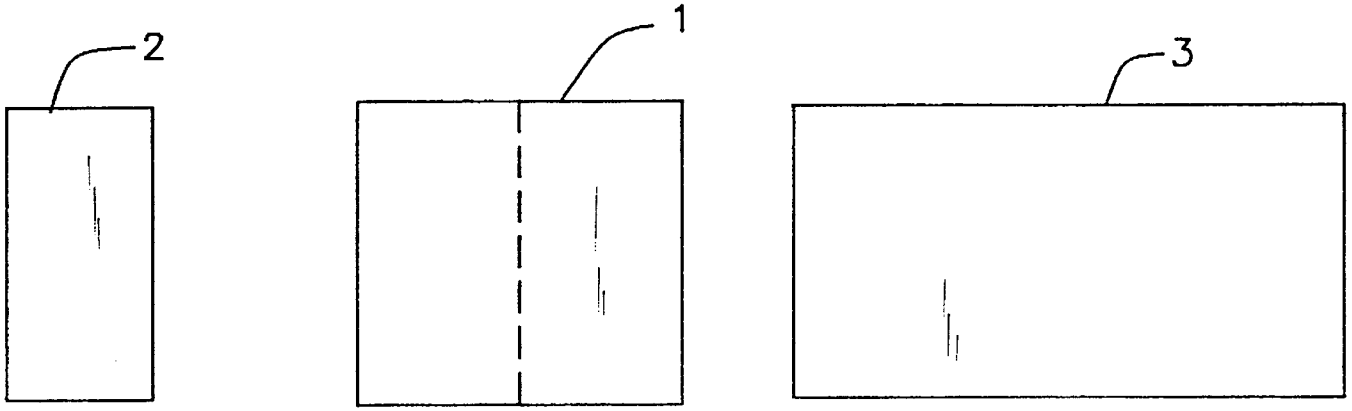
FIG. 1 is a transverse sectional view of the sample merchandise display and distribution device constructed in accordance with the invention just prior to attachment to a product and a sample.
Figure 2:
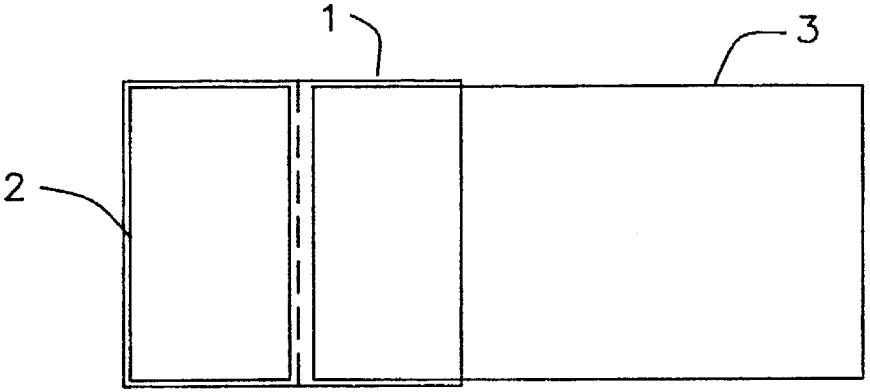
FIG. 2 is a is a transverse sectional view of the sample display and distribution device of FIG. 1 after it has been attached to a product and a sample.
Figure 3:
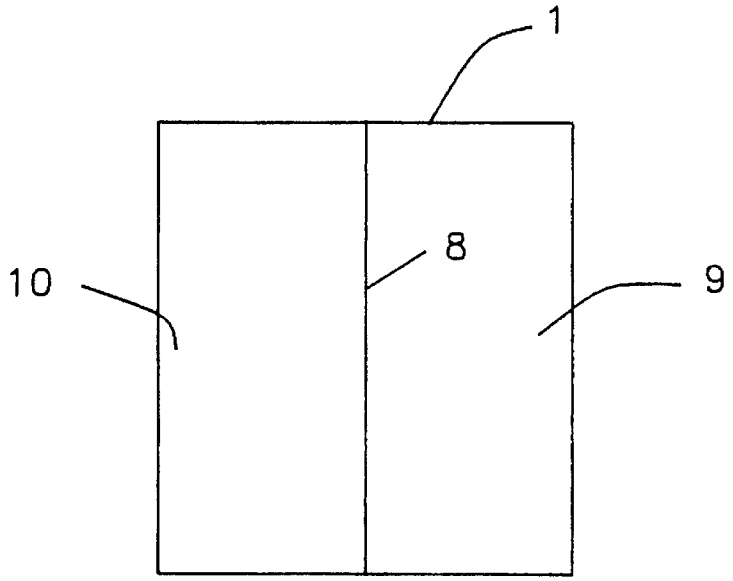
FIG. 3 is a transverse sectional view of the sample display and distribution device of FIGS. 1 and 2.
Figure 4:
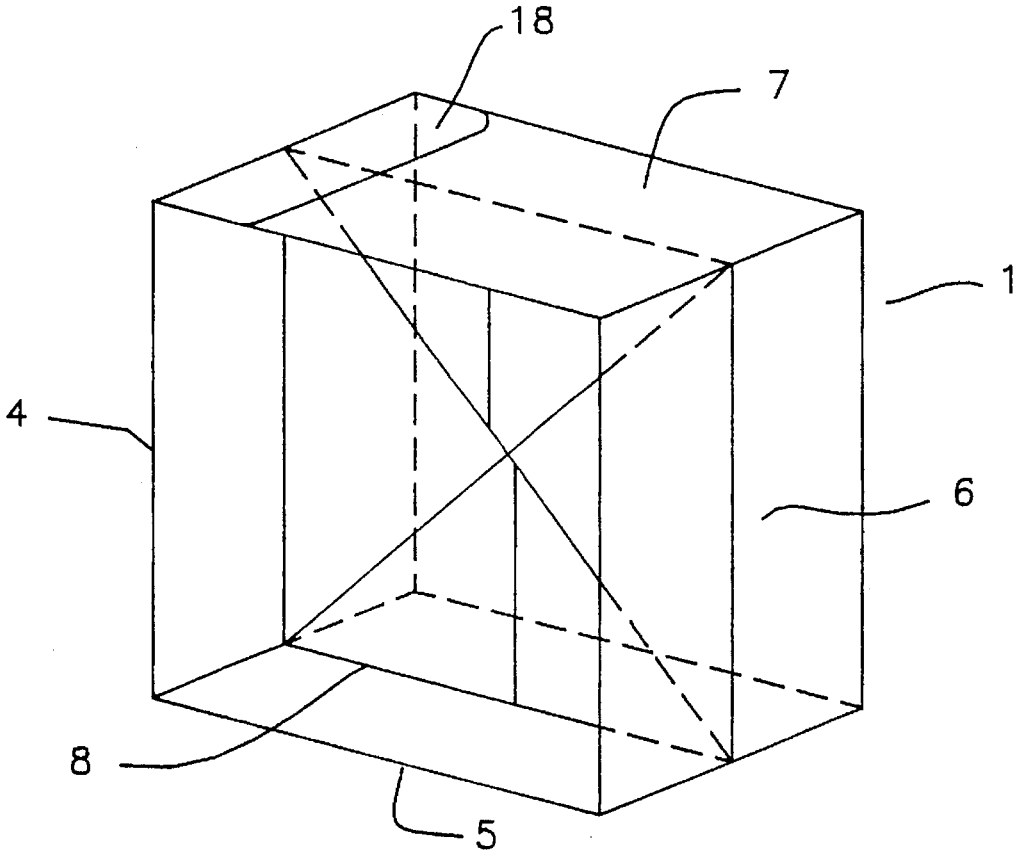
FIG. 4 is a perspective view of the sample display and distribution device of FIGS. 1, 2, and 3.

Referring now more specifically to the drawings, FIG. 1 shows the sample merchandise display and distribution device 1 of the present invention before it is attached to the product 3 or the sample 2 to be displayed and distributed. FIG. 2 shows how the sample merchandise display and distribution device 1 appears during its intended use. FIG. 3 is a cross-sectional side view and FIG. 4 is a perspective view of the sample merchandise and distribution device 1 constructed in accordance with the invention. As shown in FIGS. 3 and 4, the sample merchandise display and distribution device 1 of the present invention comprises four side walls 6', 7', 8' and 9' and an internal support wall 37 defining a first longitudinal aperture 38 and a second longitudinal aperture 39. The first longitudinal aperture 38 is sized and adapted to receive and retain a container 3 housing a retail consumer product. The second longitudinal aperture 39 is sized and adapted to receive, retain, and display a merchandise sample 2. The product 3 and the sample 2 may be secured in longitudinal openings 38 and 39 in a wide variety of ways well known to those skilled in the art as suitable for this purpose, e.g., glue, tape, interlocking tabs, etc., however in a preferred embodiment a frictional engagement is preferred because of the reduced manufacturing costs and the economy of materials and labor utilized in erecting the display. A frictional engagement also allows the consumer to more conveniently remove both the sample 2 and the product 3 and conserves natural resources. The sample display and distribution device 1 may be manufactured from a variety of materials well known to those skilled in the art as suitable for this purpose, e.g., plastic, styrofoam, and paper. Corrugate of various mediums may also be utilized. In a preferred embodiment, solid unbleached sulphate (SUS) paper, solid bleached sulphate (SBS) paper, or clay coated new board (CCNB) paper is utilized.

Figure 5:
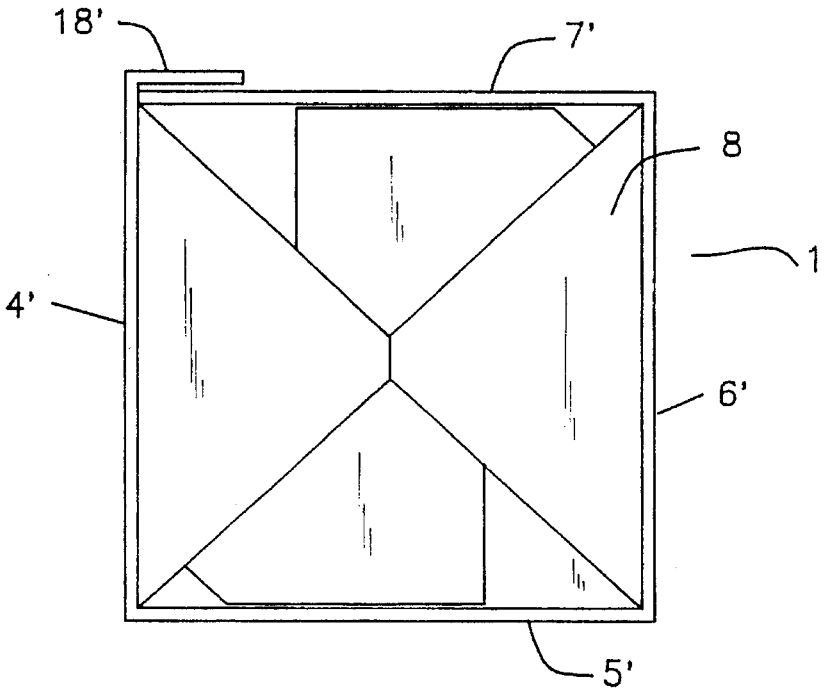
FIG. 5 is an end view of the sample display and distribution device of FIG. 4.
Figure 6:
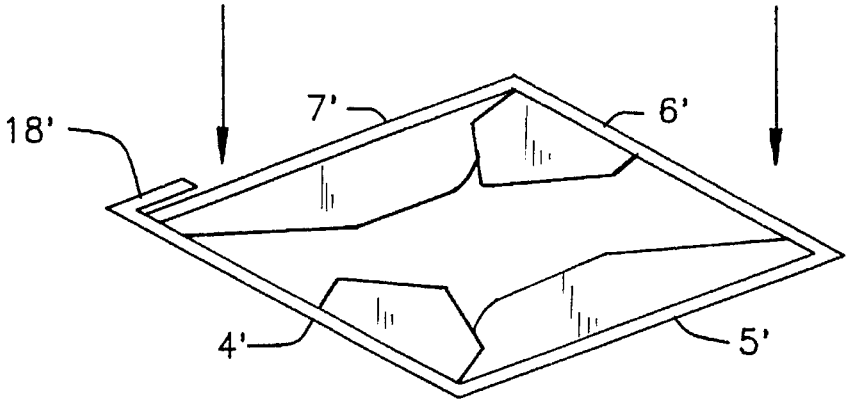
FIG. 6 is an end view of the sample display and distribution device of FIG. 5 shown in a semi-collapsed state.
Figure 7:
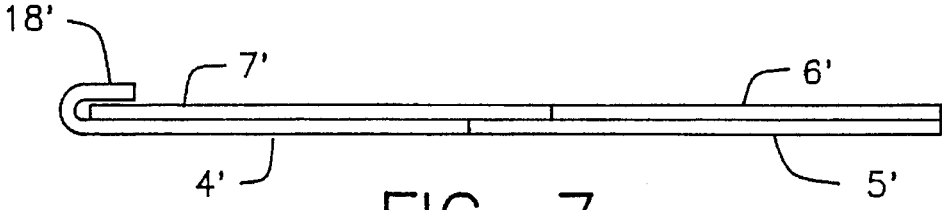
FIG. 7 is a is an end view of the sample display and distribution device of FIG. 5 shown in a collapsed state.

As shown in FIGS. 4 and 5, the internal support wall 37 is comprised of a plurality of interlocking support panel members adapted for selective engagement and disengagement with each other. The interlocking panels impart support and rigidity in the erected condition and are adapted for selective disengagement with each other to allow the sample merchandise display and distribution device 1 to be folded flat, as shown in FIGS. 6 and 7, thus, significantly reducing its volume and shipping costs.

Figure 8A:
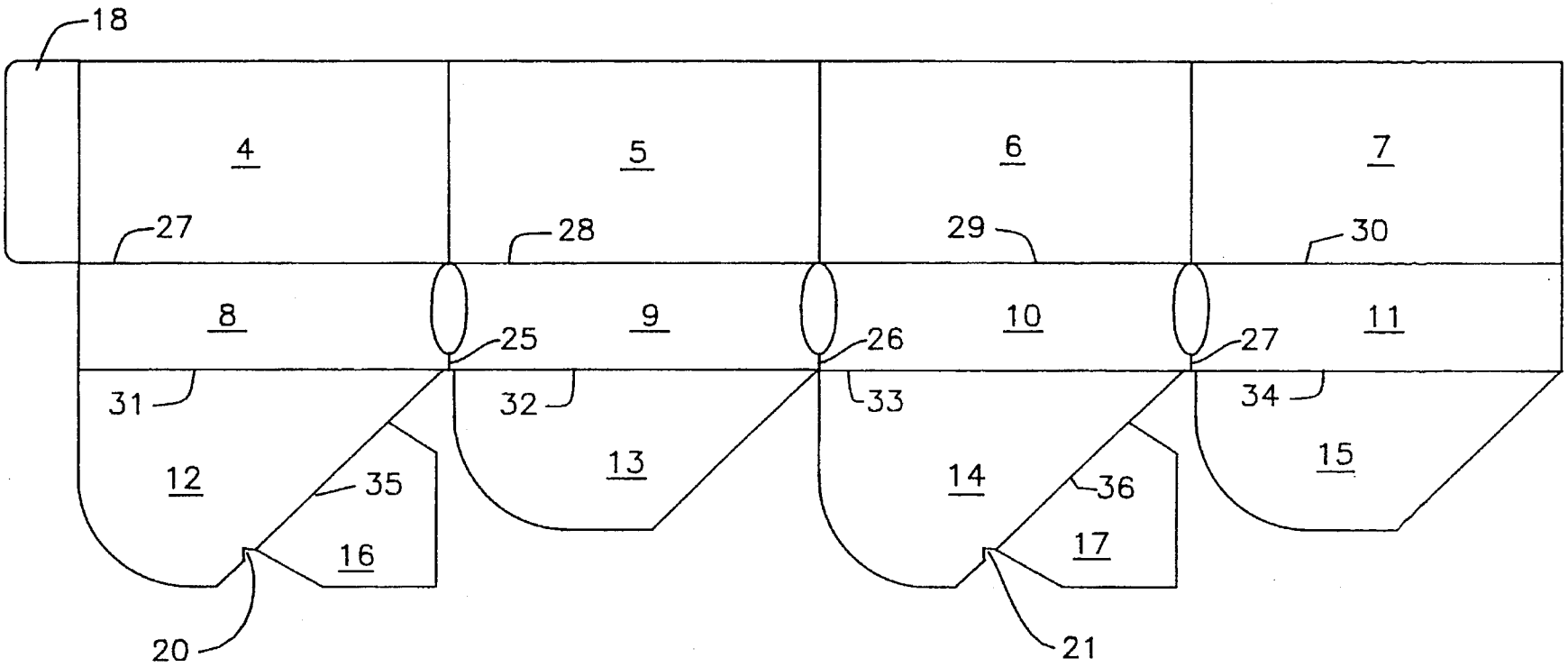
FIG. 8A is a top view of an unfolded sample display and distribution device blank constructed in accordance with the invention.
Figure 8B:
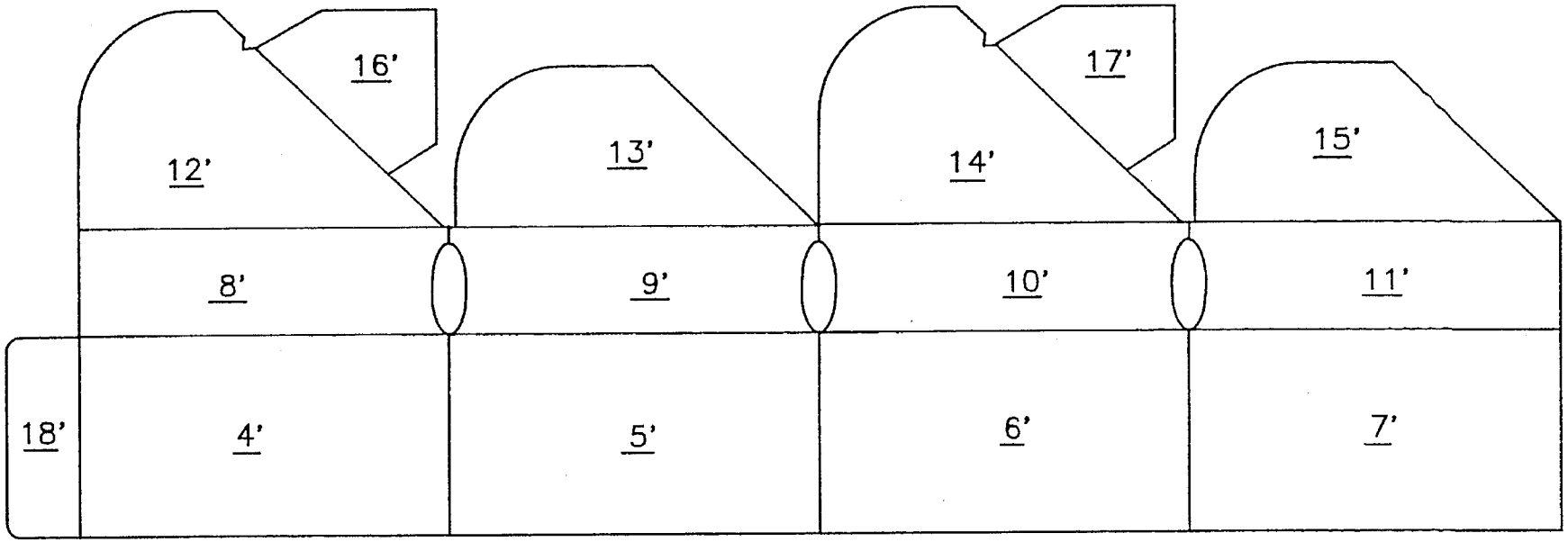
FIG. 8B is a bottom view of the unfolded sample display and distribution device blank of FIG. 8A.

In a preferred embodiment, the display and distribution device 1 is constructed from a single die-cut blank 19 having a first major surface as shown in FIG. 8A and a second major surface as shown in FIG. 8B. The blank 19 shown in FIG. 8A includes a first wall panel 4, a second wall panel 5, a third wall panel 6, a fourth wall panel 7, a first central panel 8, a second central panel 9, a third central panel 10, a fourth central panel 11, a first support panel member 12, a second support panel member 13, a third support panel member 14, a fourth support panel member 15, a first securing tab 16, a second securing tab 17, a first interlock notch 20, a second interlock notch 21, and a flap 18. The central panels 8, 9, 10, and 11, the wall panels 4, 5, 6, and 7, the support panel members 12, 13, 14, and 15, and securing tabs 16 and 17 are all in the same plane. For purposes of description, and with reference to the die-cut blank 19 shown in FIG. 8A., the first wall panel 4 projects vertically above the first central panel 8 with the integral adjacent edges defined by a full width fold line 27. The second wall panel 5 projects vertically above the second central panel 9 with the integral adjacent edges defined by a full width fold line 28. The third wall panel 6 projects vertically above the third central panel 10 with the integral adjacent edges defined by a full width fold line 29. The fourth wall panel 7 projects vertically above the fourth central panel 11 with the integral adjacent edges defined by a full width fold line 30.

First support panel member 12 extends vertically and below first central panel 8 with the integral adjacent edges defined by a full width fold line 31. Second support panel member 13 extends vertically and below second central panel 9 with the integral adjacent edges defined by a full width fold line 32. Third support panel member 14 extends vertically and below third central panel 10 with the integral adjacent edges defined by a full width fold line 33. Fourth support panel 15 extends vertically and below fourth central panel 11 with the integral adjacent edges defined by a full width fold line 34.

First securing tab 16 is attached to first support panel member 12 with the integral edges defined by a full width fold line 35. Second securing tab 17 is attached to third support panel member 14 with the integral edges defined by a full width fold line 36.

The second wall panel 5 projects laterally to the right of first wall panel 4 and is hingedly integral therewith along a full fold or crease line 22. The third wall panel 6 projects laterally to the right of second wall panel 5 and is hingedly integral therewith along a full fold or crease line 23. The fourth wall panel 7 projects laterally to the right of third wall panel 6 and is hingedly integral therewith along a full fold or crease line 24.

The second central panel 9 projects laterally to the right of first central panel 8 and is hingedly integral therewith along a fold or crease line 25. The third central panel 10 projects laterally to the right of second central panel 9 and is hingedly integral therewith along a fold or crease line 26. The fourth central panel 11 projects laterally to the right of third central panel 10 and is hingedly integral therewith along a fold or crease line 27.

FIG. 8B shows the second major surface, i.e., the opposite side, of the die-cut blank shown in FIG. 8A. The blank 19 shown in FIG. 8B includes a first wall panel 4', a second wall panel 5', a third wall panel 6', a fourth wall panel 7', a first central panel 8', a second central panel 9', a third central panel 10', a fourth central panel 11', a first support panel member 12', a second support panel member 13', a third support panel member 14', a fourth support panel member 15', a first securing tab 16', a second securing tab 17', and a flap 18'.

Figure 9:
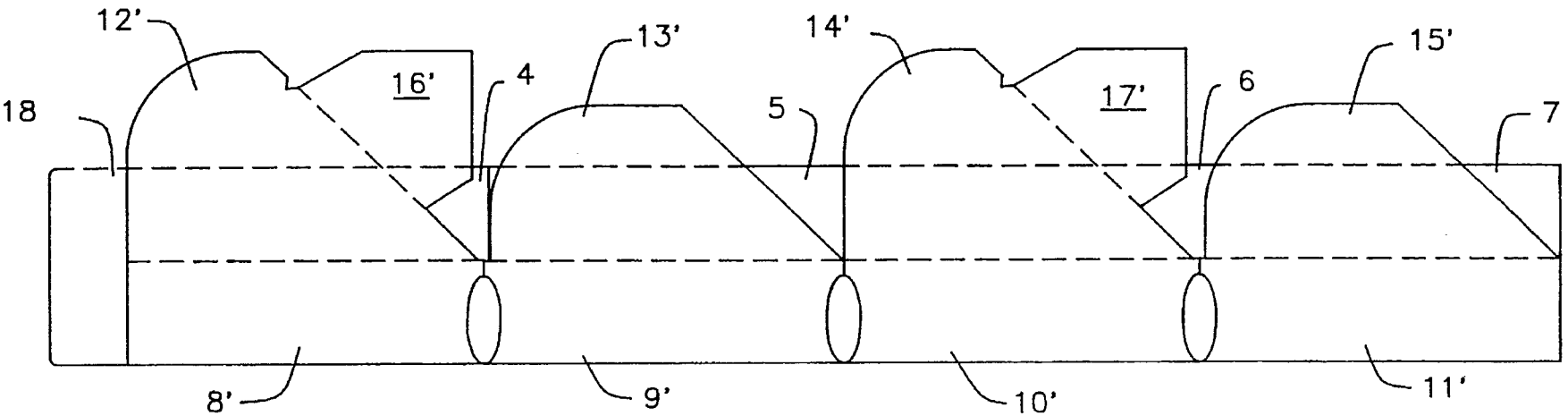
FIG. 9 is a is a top view of the sample display and distribution device of FIG. 8A with a portion partially folded.
Figure 10:
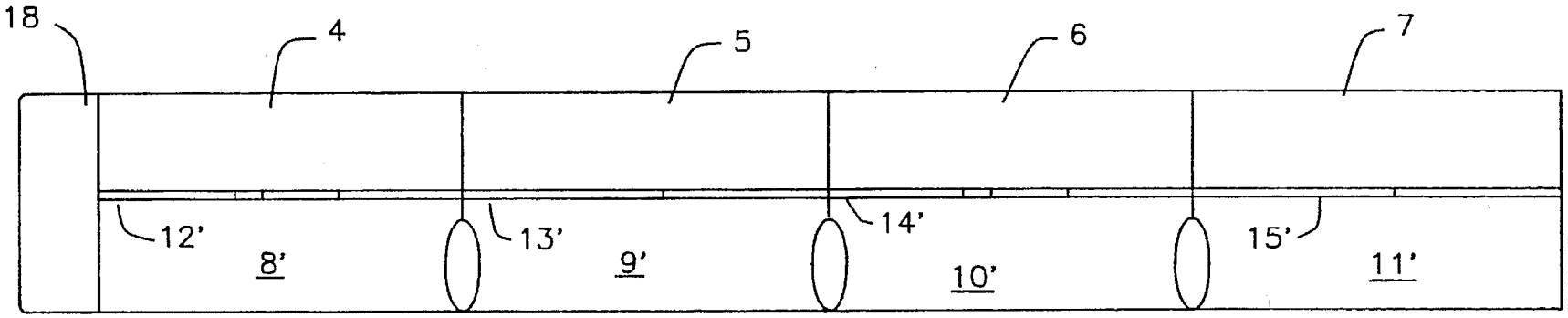
FIG. 10 is a top view of the sample display and distribution device of FIG. 9 with a portion folded out of the plane of the paper towards the viewer.
Figure 11:
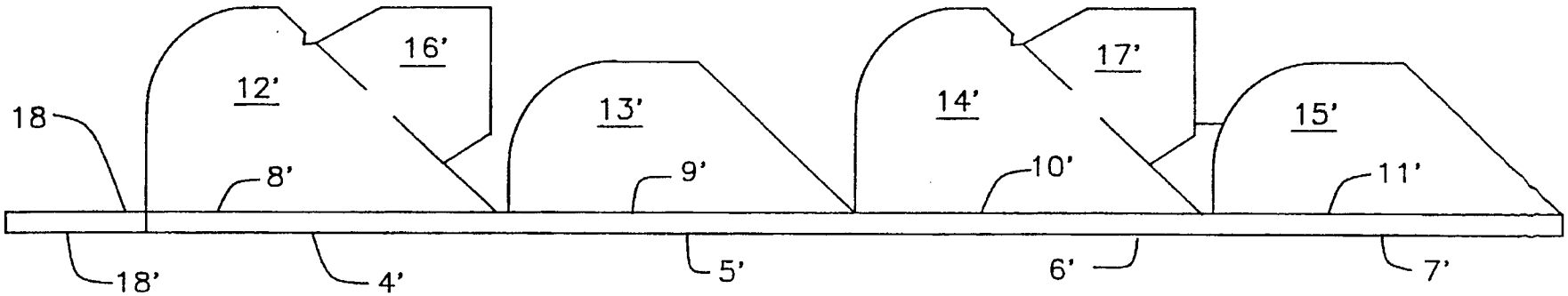
FIG. 11 is a side view of the sample display and distribution device of FIG. 10.
Figure 12:
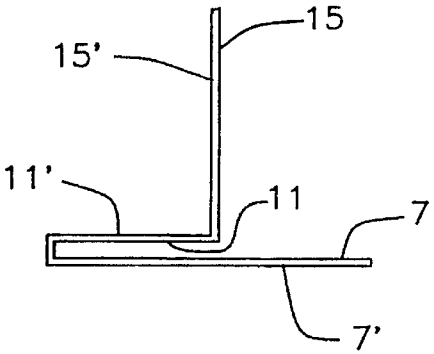
FIG. 12 is an end view of the sample display and distribution device of FIGS. 10 and 11.

To prepare the sample merchandise display and distribution device 1, the die-cut blank 19 is folded as shown in FIG. 9 so that first central panel 8 and first support panel member 12 are in contact with first wall panel 4, second central panel 9 and second support panel member 13 are in contact with second wall panel 5, third central panel 10 and third support panel member 14 are in contact with third wall panel 6, and fourth central panel 11 and fourth support panel member 15 are in contact with fourth wall panel 7. As shown in FIG. 9, folding the blank in this manner exposes to the viewer support panel member surfaces 12', 13', 14', and 15' and central panel surfaces 8', 9', 10', and 11'. As shown in FIGS. 10 and 11 and 12, support panel members 12', 13', 14', and 15' are then folded in a direction away from wall panels 4, 5, 6, and 7 to an angle substantially perpendicular to wall panels 4, 5, 6, and 7. FIG. 11 is a side view of FIG. 10 and FIG. 12 is an end view of FIG. 10.

Figure 13:
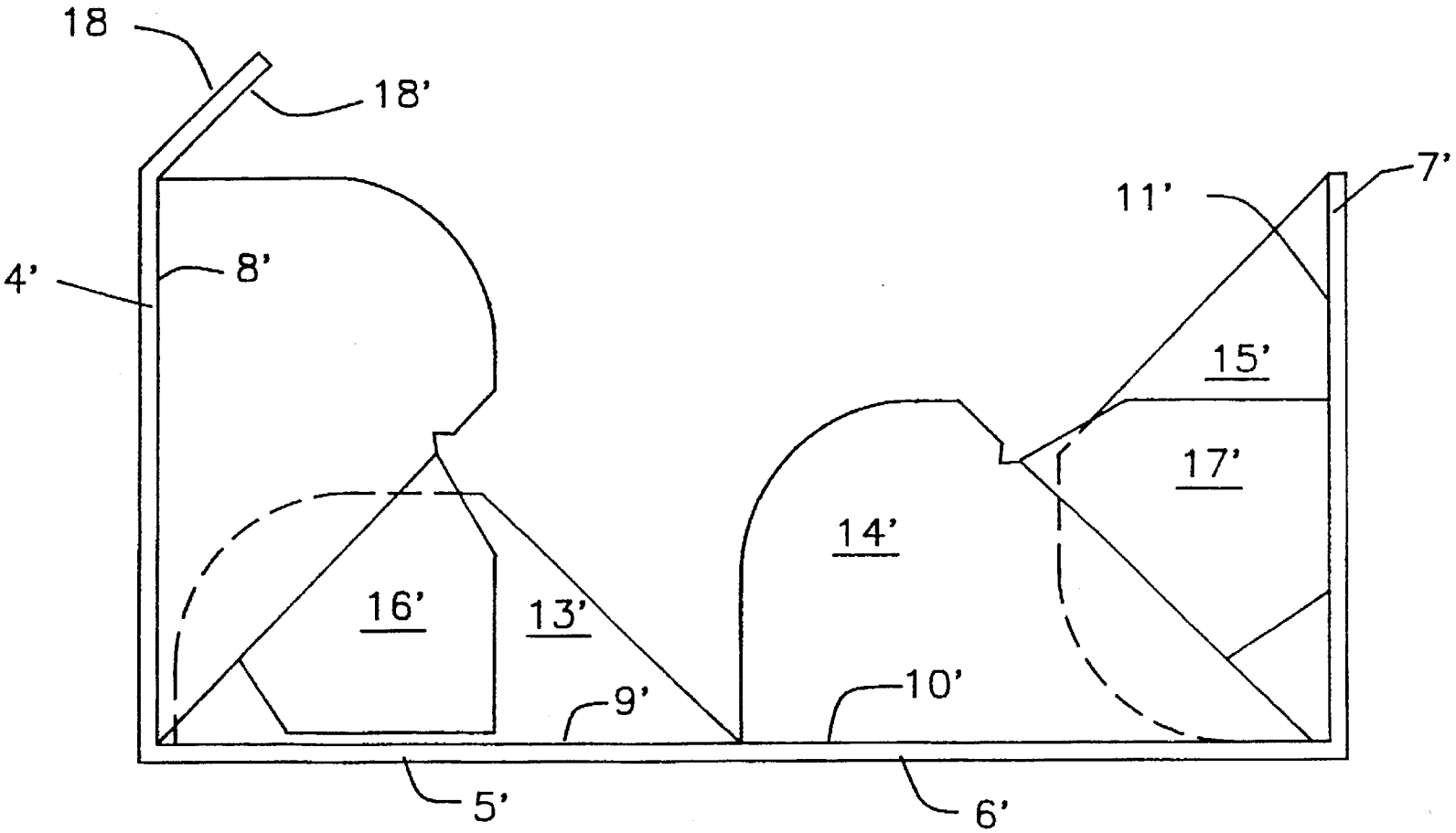
FIG. 13 is a side view of the sample merchandise display and distribution device of FIG. 11.

The blank 19 depicted in FIGS. 10, 11, and 12 is then folded so that surfaces 11' and 7' are substantially perpendicular to surfaces 10' and 6' and surfaces 8' and 4' are substantially perpendicular to surfaces 9' and 5' as shown in FIG. 13. Surfaces 11' and 7' are folded to a position substantially perpendicular with surfaces 8' and 4' and surfaces 10' and 6' are folded to a position substantially perpendicular to surfaces 9' and 5' resulting in the sample display and distribution device as shown in FIG. 5.

Flap surface 18 is folded and secured to surface 7' to maintain the configuration of the sleeve. The flap surface 18 may be secured in a variety of ways well known to those skilled in the art as suitable for this purpose, e.g., stapling, taping, crimping, etc., however in a preferred embodiment, an adhesive is utilized. The support panel members 12', 13', 14', and 15' are then engaged and interlocked to form the internal support wall 37. In an especially preferred embodiment, first securing tab surface 16 is secured to second support panel surface 13' and second securing tab surface 17 is secured to fourth support panel member surface 15'. The securing tabs 16 and 17 may be secured in a variety of ways well known to those skilled in the art as suitable for this purpose, e.g., stapling, taping, crimping, etc., however in a preferred embodiment, an adhesive is utilized.

Figure 14A:
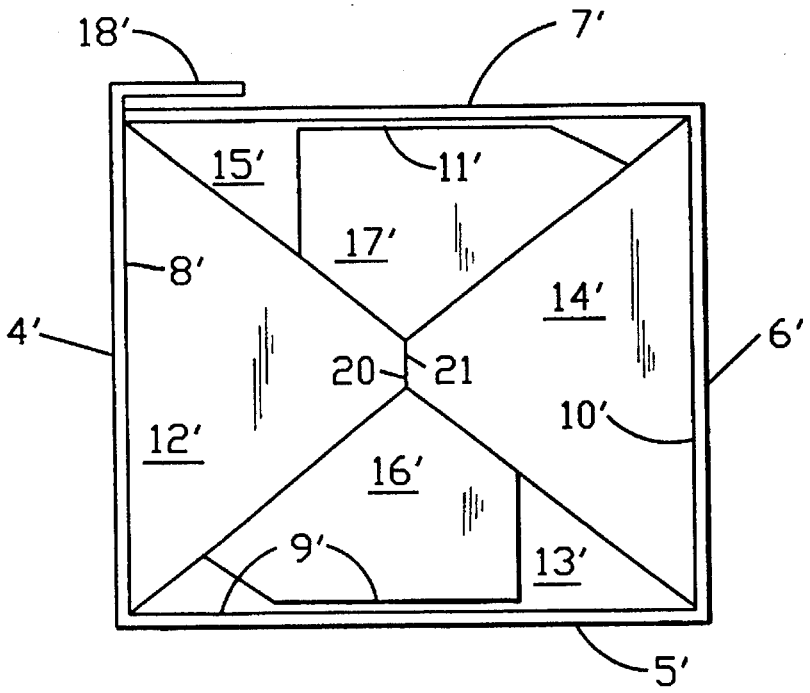
FIG. 14A is a side view of the sample merchandise display and distribution device of FIG. 11 shown in the completely erected position.
Figure 14B:
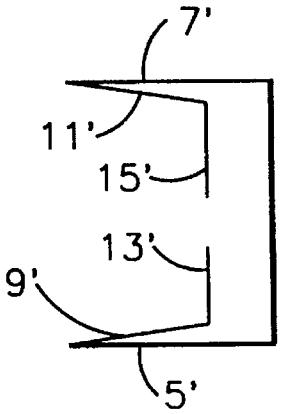
FIG. 14B is a side view of FIG. 14A.

FIG. 14B is a side view of FIG. 14A and shows wall panel 5', central panel 9', support panel member 13', wall panel 7', central panel 11' and support panel member 15'. The central panels 9' and 11' cooperate with wall panels 5' and 7' to form a double wall. This double wall provides additional protection and crush resistance to a sample 2 inserted into the opening 39 because the double wall resists compressive forces applied along the longitudinal and transverse axes of the sample merchandise display and distribution device 1.

Figure 15:
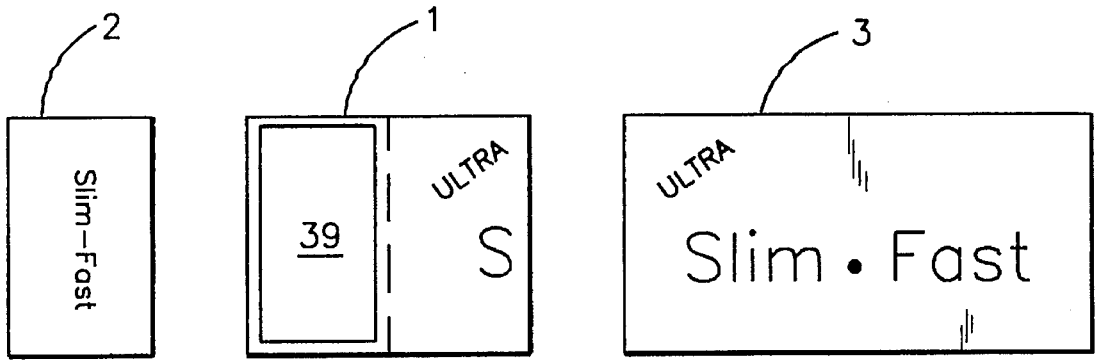
FIG. 15 shows an alternative embodiment of the invention.
Figure 16:
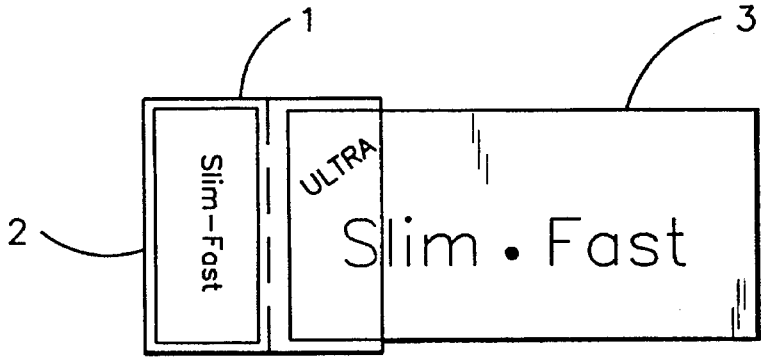
FIG. 16 shows an alternative embodiment of the invention.

In an alternative embodiment, shown in FIGS. 15 and 16, the walls defining the second longitudinal opening 39 are provided with one or more viewing apertures 40 to allow the sample 2 to be viewed from the side when the sample 2 is inserted into second longitudinal opening 39. The exterior of the sample merchandise and distribution device 1 may also be marked with indicia corresponding to and sized and positioned to be in registry with the external markings on the package 3 when it is inserted into first longitudinal opening 38 so as to provide a neat and attractive appearance as shown in FIGS. 15 and 16.

Figure 17:
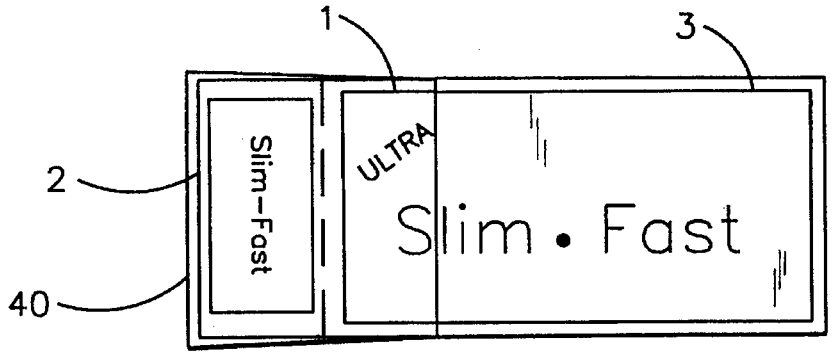
FIG. 17 shows the device of FIG. 16 with a transparent external wrapping applied.

In a preferred embodiment, the assembled apparatus is provided with an external wrapping to provide additional rigidity, stability, and protection to the product and the sample. FIG. 17 shows the apparatus of FIG. 16 with a transparent external wrapping 40 applied. The wrapping 40 may be chosen from a variety of wrappings well known to those skilled in the art as suitable for this purpose, however, in an especially preferred embodiment a heat shrinkable wrapping film is utilized. The external wrapping 40 may be opaque, translucent or transparent and may be provided with decorative indicia or markings.

While particular embodiments of this invention have been shown in the drawings and described above, it will be apparent that many changes may be made in the form, arrangement, and positioning of the various elements of the combination. In consideration thereof, it should be understood that preferred embodiments of this invention disclosed herein are intended to be illustrative only and not intended to limit the scope of the invention.

What is claimed is:

1. A merchandise display and distribution apparatus comprising:

a) a first wall panel, a second wall panel, a third wall panel, and a fourth wall panel;

b) a first central panel, a second central panel, a third central panel, and a fourth central panel;

c) a first support panel, a second support panel, a third support panel, and a fourth support panel, said first support panel provided with a first interlock notch and a first securing tab, said first securing tab sized and disposed to engage said second support panel when said blank is formed into a merchandise display and distribution apparatus, said third support panel provided with a second interlock notch and a second securing tab, said second securing tab sized and disposed to engage said fourth support panel when said blank is formed into a merchandise display and distribution apparatus;

d) a first fold line disposed between and connecting said first wall panel and said second wall panel, a second fold line disposed between and connecting said second wall panel and said third wall panel, a third fold line disposed between and connecting said third wall panel and said fourth wall panel, a fourth fold line disposed between and connecting said first wall panel and said first central panel, a fifth fold line disposed between and connecting said second wall panel and said second central panel, a sixth fold line disposed between and connecting said third wall panel and said third central panel, a seventh fold line disposed between and connecting said fourth wall panel and said fourth central panel, an eighth fold line disposed between and connecting said first central panel and said second central panel, a ninth fold line disposed between and connecting said second central panel and said third central panel, a tenth fold line disposed between and connecting said third central panel and said fourth central panel, an eleventh fold line disposed between and connecting first central panel and said first support panel, a twelfth fold line disposed between and connecting said second central panel and said second support panel, a thirteenth fold line disposed between and connecting said third central panel and said third support panel, a fourteenth fold line disposed between and connecting said fourth central panel and said fourth support panel, a fifteenth fold line disposed between and connecting said first support panel and said first securing tab, a sixteenth fold line disposed between and connecting said third support panel and said second securing tab; and e) a flap attached to said first wall panel said flap disposed substantially opposite said second wall panel.

2. The apparatus of claim 1, wherein said support wall forms an angle substantially perpendicular to said inner wall of said sleeve.

3. The apparatus of claim 2, wherein said sleeve and said support wall are selectively collapsible and erectable.

4. The apparatus of claim 3, wherein said support wall is comprised of a plurality of panels adapted for selective engagement and disengagement with each other.

5. The apparatus of claim 4, further comprising a wrapping applied to the exterior of said apparatus.

6. The apparatus of claim 5, wherein said wrapping is of the heat shrinkable type.

7. The apparatus of claim 5, wherein said wrapping is provided with markings.

8. The apparatus of claim 4, wherein said outer wall and said inner wall defining said second longitudinal aperture are provided with a viewing aperture for viewing said product sample.

9. The apparatus of claim 8, wherein said outer wall defining said first longitudinal aperture is marked with indicia corresponding to and in registry with the outer markings of said consumer product.

10. A method of displaying and distributing a product sample, comprising the steps of:

a) preparing a blank comprising:

a) a first wall panel, a second wall panel, a third wall panel, and a fourth wall panel;

b) a first central panel, a second central panel, a third central panel, and a fourth central panel;

c) a first support panel, a second support panel, a third support panel, and a fourth support panel, said first support panel provided with a first interlock notch and a first securing tab, said first securing tab sized and disposed to engage said second support panel when said blank is formed into a merchandise display and distribution apparatus, said third support panel provided with a second interlock notch and a second securing tab, said second securing tab sized and disposed to engage said fourth support panel when said blank is formed into a merchandise display and distribution apparatus;

d) a first fold line disposed between and connecting said first wall panel and said second wall panel, a second fold line disposed between and connecting said second wall panel and said third wall panel, a third fold line disposed between and connecting said third wall panel and said fourth wall panel, a fourth fold line disposed between and connecting said first wall panel and said first central panel, a fifth fold line disposed between and connecting said second wall panel and said second central panel, a sixth fold line disposed between and connecting said third wall panel and said third central panel, a seventh fold line disposed between and connecting said fourth wall panel and said fourth central panel, an eighth fold line disposed between and connecting said first central panel and said second central panel, a ninth fold line disposed between and connecting said second central panel and said third central panel, a tenth fold line disposed between and connecting said third central panel and said fourth central panel, an eleventh fold line disposed between and connecting first central panel and said first support panel, a twelfth fold line disposed between and connecting said second central panel and said second support panel, a thirteenth fold line disposed between and connecting said third central panel and said third support panel, a fourteenth fold line disposed between and connecting said fourth central panel and said fourth support panel, a fifteenth fold line disposed between and connecting said first support panel and said first securing tab, a sixteenth fold line disposed between and connecting said third support panel and said second securing tab; and e) a flap attached to said first wall panel said flap disposed substantially opposite said second wall panel;

b) erecting said blank to form an apparatus comprising: a sleeve having a first end and a second end and an outer wall and an inner wall defining a longitudinal bore therethrough; a support wall having a first major surface and a second major surface positioned within said longitudinal bore between said first end and said second end, said first major surface of said support wall facing said first end of said sleeve, said first major surface of said support wall and the portion of said interior wall between said first major surface and said first end of said sleeve defining a first longitudinal aperture, said second major surface of said support wall and the portion of said interior wall between said second major surface and said second end of said sleeve defining a second longitudinal aperture, said first longitudinal aperture adapted to receive and retain a container housing a consumer product, and said second longitudinal aperture adapted to receive, retain, and display a product sample;

c) inserting a consumer product into said first longitudinal aperture; and d) inserting a product sample into said second longitudinal aperture.

11. The method of claim 10, further comprising the step of applying an external wrapping to said apparatus.

12. The method of claim 11, wherein said wrapping is a heat shrinkable type wrapping.

13. The method of claim 12, further comprising the step of applying markings to said wrapping.

* * * * *